US007392549B1

(12) United States Patent
Barber

(10) Patent No.: US 7,392,549 B1
(45) Date of Patent: Jul. 1, 2008

(54) CONVERTIBLE TRAVEL GARMENT

(76) Inventor: Jason Barber, P.O. Box 536816, Orlando, FL (US) 32853

( * ) Notice: Subject to any disclaimer, the term of this patent is extended or adjusted under 35 U.S.C. 154(b) by 63 days.

(21) Appl. No.: 11/302,979

(22) Filed: Dec. 14, 2005

Related U.S. Application Data

(60) Provisional application No. 60/635,742, filed on Dec. 14, 2004.

(51) Int. Cl.
*A41D 3/02* (2006.01)
*A41D 27/10* (2006.01)

(52) U.S. Cl. ..... 2/86; 2/269; 2/DIG. 3

(58) Field of Classification Search ..... 2/269, 2/102, 69, DIG. 3, 100, 124, 86; 441/106, 441/117, 118, 114, 115, 102
See application file for complete search history.

(56) References Cited

U.S. PATENT DOCUMENTS 2,607,934 A * 8/1952 Bailhe ..... 441/107
4,059,852 A * 11/1977 Crane ..... 2/456
4,089,065 A * 5/1978 McGee ..... 2/456
4,302,850 A * 12/1981 Maeshima ..... 2/102
4,310,927 A * 1/1982 DeBose ..... 2/115
4,547,906 A * 10/1985 Nishida et al. ..... 2/93
4,569,089 A * 2/1986 Nesse ..... 2/108
4,767,371 A * 8/1988 Jackson ..... 441/94
4,825,469 A * 5/1989 Kincheloe ..... 2/456
4,864,656 A * 9/1989 Nesse ..... 2/97
4,977,623 A * 12/1990 DeMarco ..... 2/456
4,999,850 A * 3/1991 Grilliot et al. ..... 2/126
5,091,992 A * 3/1992 Pusic ..... 2/456
5,152,706 A * 10/1992 Fister ..... 441/106
5,255,390 A * 10/1993 Gross et al. ..... 2/458
5,259,070 A * 11/1993 De Roza ..... 2/413
5,303,425 A * 4/1994 Mele ..... 2/115
5,458,516 A * 10/1995 Uglene et al. ..... 441/104
5,603,646 A * 2/1997 Tobias ..... 441/94
5,628,064 A * 5/1997 Chung ..... 2/70
5,717,999 A * 2/1998 Lurry ..... 2/69
5,718,000 A * 2/1998 Ost et al. ..... 2/69
5,823,838 A * 10/1998 Darcy et al. ..... 441/106
5,937,443 A * 8/1999 Kageyama et al. ..... 2/69
5,967,870 A * 10/1999 Bertoncelli et al. ..... 441/107
6,032,299 A * 3/2000 Welsh ..... 2/456
6,062,929 A * 5/2000 Hallstrom ..... 441/106
6,088,841 A * 7/2000 Pozzer ..... 2/456
6,125,478 A * 10/2000 Alaloof ..... 2/456

(Continued)

FOREIGN PATENT DOCUMENTS

GB 2223395 A * 4/1990

*Primary Examiner*—Alissa L Hoey
(74) *Attorney, Agent, or Firm*—Allen, Dyer, Doppelt Milbrath & Gilchrist, P.A.

(57) ABSTRACT

A garment includes a garment body adapted for covering at least the torso of a person, said garment body having an outer surface and an inner surface; at least one sleeve detachably connected to said garment body; at least one sleeve pocket adapted for storing said two sleeves when detached from said garment body; a collar detachably connected along an upper periphery of said garment body, said collar having an associated inflatable cushion; a lumbar support positioned along a back portion of said garment body, said lumbar support including an inflatable cushion; and a plurality of pockets including at least one pocket having an outlet opening along the inner surface of said garment.

23 Claims, 5 Drawing Sheets

U.S. PATENT DOCUMENTS 6,230,333 B1 * 5/2001 Umeda ..... 2/463
6,260,201 B1 * 7/2001 Rankin ..... 2/69
6,279,162 B1 * 8/2001 Silverthorn ..... 2/108
6,298,487 B1 * 10/2001 Mayhew ..... 2/108
6,301,714 B1 * 10/2001 Son ..... 2/129
6,314,579 B1 * 11/2001 Marcon ..... 2/102
6,543,054 B2 * 4/2003 Gabriel ..... 2/1
6,564,387 B1 * 5/2003 Willoughby ..... 2/69
6,757,916 B2 * 7/2004 Mah et al. ..... 2/456
6,766,535 B2 * 7/2004 Duhamell et al. ..... 2/102
6,951,033 B2 * 10/2005 Dainese ..... 2/69
7,007,307 B2 * 3/2006 Takeuchi ..... 2/102
7,059,924 B2 * 6/2006 Farmer et al. ..... 441/106
7,201,626 B1 * 4/2007 Nelson et al. ..... 441/106
2001/0052142 A1 * 12/2001 Marcon ..... 2/102
2002/0137409 A1 * 9/2002 Chern et al. ..... 441/102
2003/0188371 A1 * 10/2003 Duhammel et al. ..... 2/102
2004/0082237 A1 * 4/2004 Farmer et al. ..... 441/106
2005/0101203 A1 * 5/2005 Kemp ..... 441/106

* cited by examiner

CONVERTIBLE TRAVEL GARMENT

RELATED APPLICATION

This application claims priority from now abandoned provisional application Ser. No. 60/635,742, which was filed on Dec. 14, 2004, and which is incorporated herein by reference in its entirety.

FIELD OF THE INVENTION

This invention relates to garments and, more specifically, to a convertible travel garment.

BACKGROUND OF THE INVENTION

Travelers typically require protective garments adaptable to various environmental conditions that might be encountered. In addition, the modern traveler often carries a cellular telephone or other wireless communication equipment such as personal digital assistant (PDA) devices.

Moreover, the traveler often experiences some degree of lack of comfort while seated in airplanes, trains, or other conveyances. There is, therefore, the need for a travel garment which can be adapted to changing environmental temperatures, that provides ample storage and carrying capacity for electronic equipment, and that additionally includes sufficient cushioning for the traveler to aid in reducing muscle aches brought on by long periods of sitting.

SUMMARY OF THE INVENTION

With the foregoing in mind, the present invention advantageously provides a garment suitable for travelers. The garment comprises a garment body adapted for covering at least the torso of a person, the garment body having an outer surface and an inner surface. At least one sleeve and preferably two are detachably connected to the garment body. A sleeve pocket adapted for storing the two sleeves when detached from the garment body. A collar is detachably connected along an upper periphery of the garment body, the collar having an associated inflatable cushion. A lumbar support is positioned along a back portion of the garment body, the lumbar support including an inflatable cushion. A plurality of pockets on the garment includes at least one pocket having an outlet opening along the inner surface of the garment.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which:

FIG. 3 shows a back elevation view of the vest of FIG. 1, wherein FIG. 1A shows a closeup detail of the vest's back with its inflatable cushion;

FIG. 4 shows detail of the convertible vest's removable inflatable collar, wherein

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
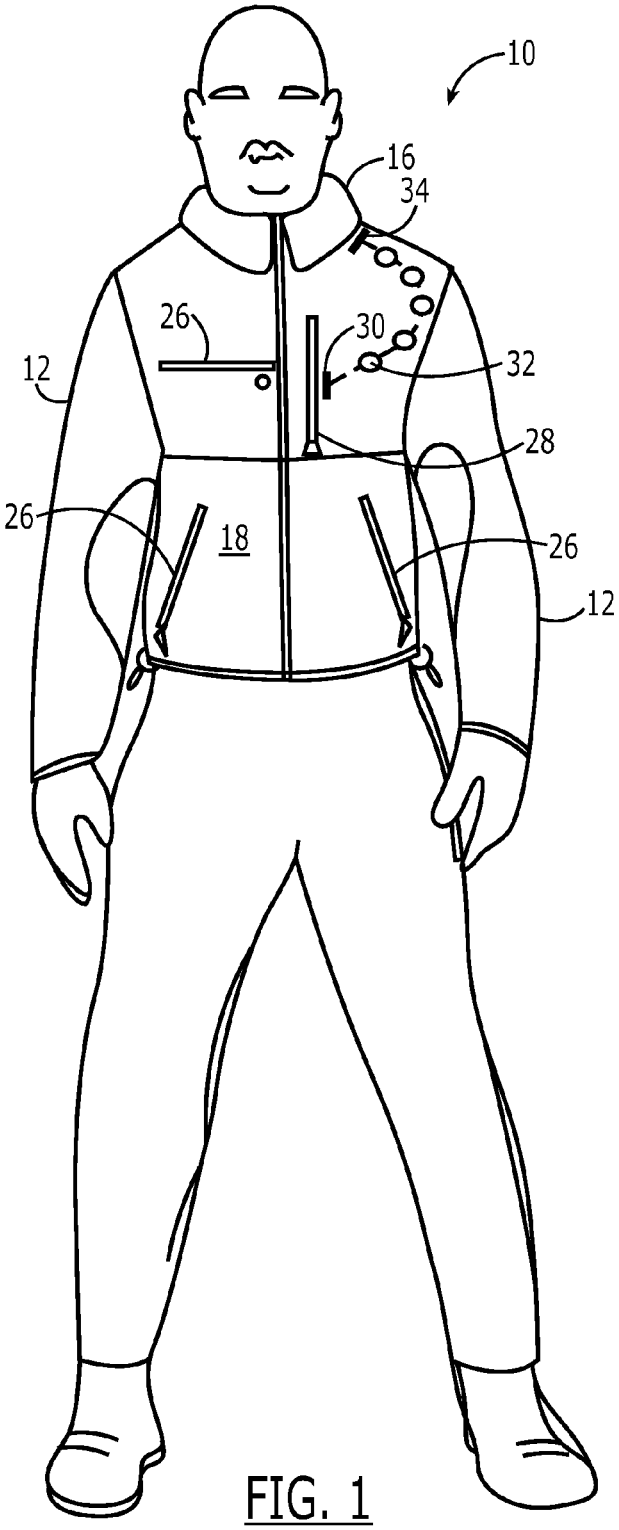
FIG. 1 is an overall front view of the convertible vest as worn by a user according to an embodiment of the present invention.
Figure 4A:
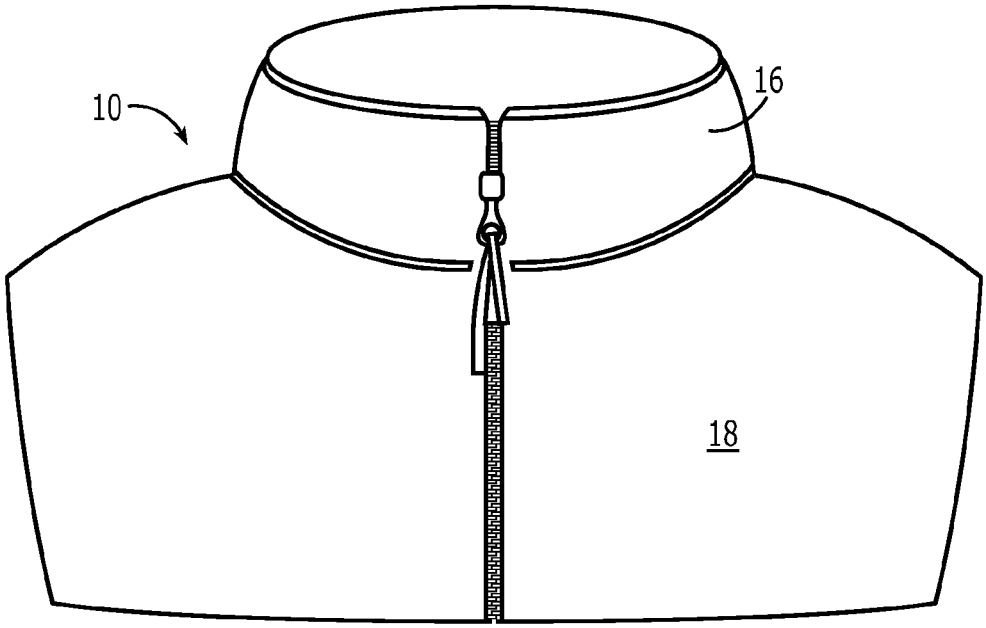
FIG. 4A shows the collar in its deflated state and FIG. 4B shows the collar inflated but still attached to the convertible vest.
Figure 4B:
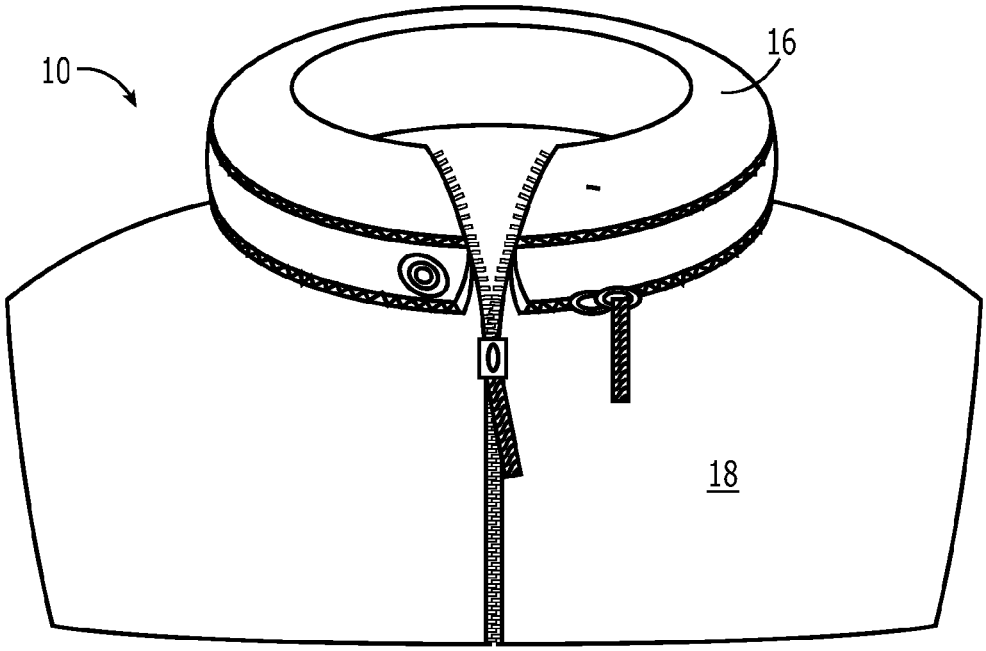
Figure 5:
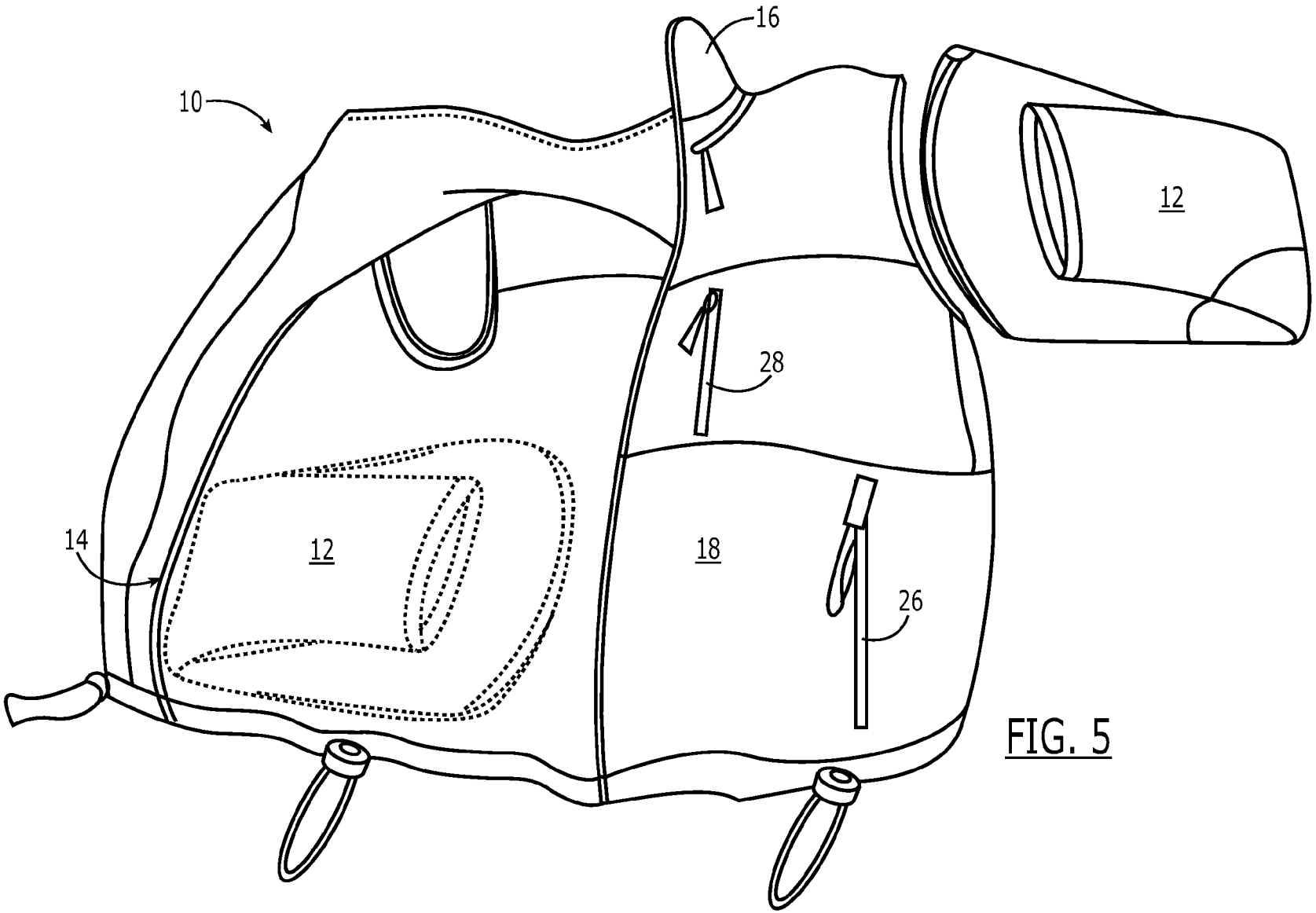
FIG. 5 is an exploded view showing detail of the vest's removable sleeves and sleeve-storage pockets.

As shown in FIGS. 1-6, the presently described convertible travel garment 10 or vest includes a number of novel structural features. FIG. 1 provides a front view of the presently described convertible garment 10. It should be understood that the term "convertible" is used herein to indicate that the vest includes changeable structural features, for example, the removable sleeves 12 which may be self-stored in sleeve storage pockets 14 provided in the vest, as best shown in FIG. 5. Similarly, the term "vest" likewise describes the present convertible travel garment, particularly when the detachable sleeves 12 are taken off. Additionally, the term "closure" preferably indicates a zipper type of closure, but it is intended to also cover any other closure, such as Velcro®, buttons, toggles, etc.

Other changeable structural features in the convertible vest include a removable, inflatable collar 16, as shown in FIG. 4. The collar itself may be inflatable and may be entirely detachable from the garment body 18. Alternatively, the collar 16 may be a sleeve or pocket which houses an inflatable cushion. This cushion may be removable in the sense that it may be taken out of the collar for use by the traveler otherwise.

Figure 6:
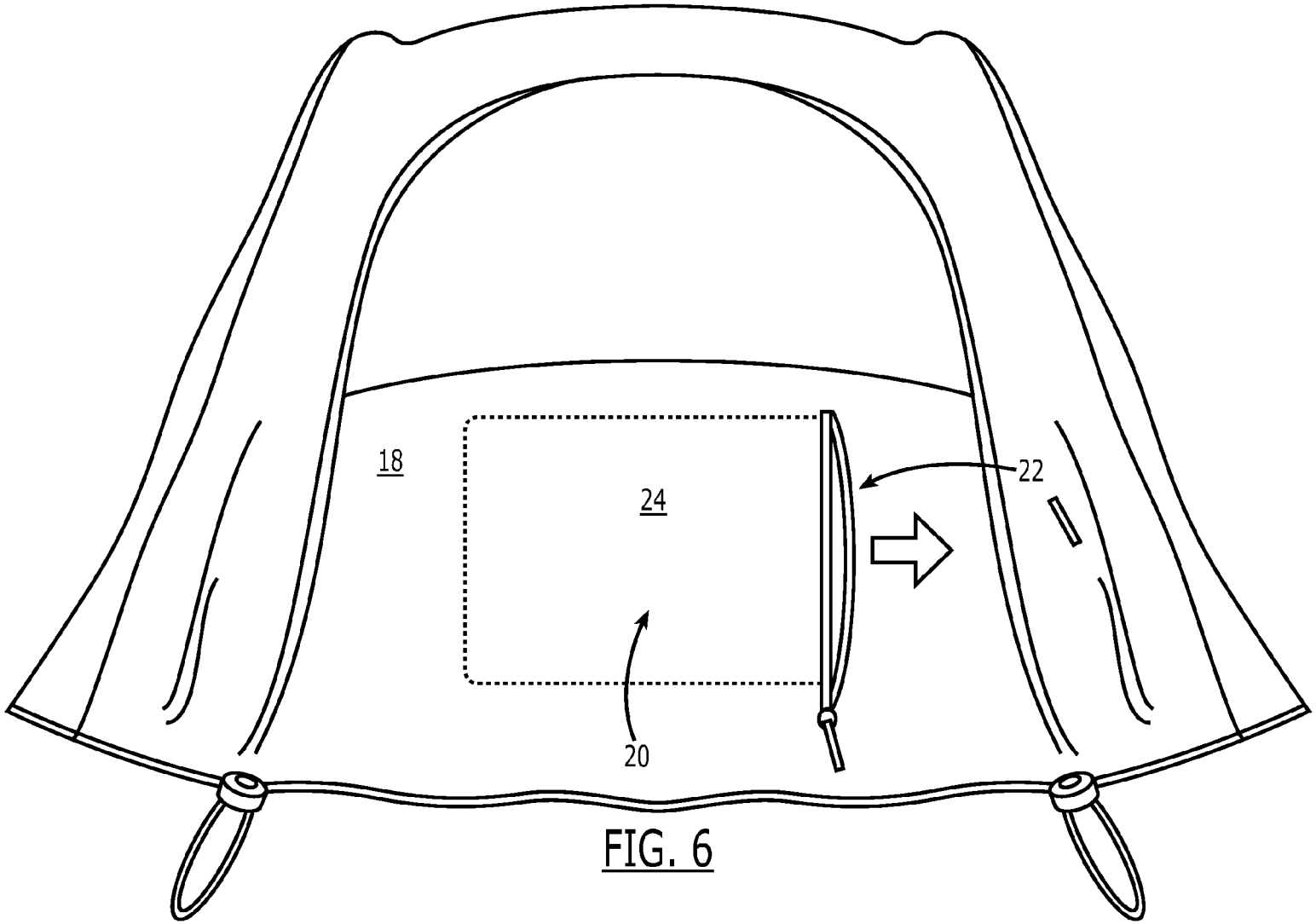
FIG. 6 shows an interior view of the back of the convertible vest, where in a preferred embodiment of same there is a pocket containing an inflatable cushion for providing the traveler with lumbar support.

Yet an additional changeable structural feature of the convertible vest 10 includes an inflatable lumbar support 20. Like the collar 16, the lumbar support 20 may include a pocket 22 positioned along the back of the garment, the pocket having a cushion 24 positioned therein for providing lumbar support to the traveler when inflated. The pocket 22 located along the back of the vest is preferably an internal pocket, that is, having a closure and a pocket opening along an inner surface of the vest as shown in FIG. 6. Alternatively, this pocket could open along an external surface of the vest's back, as seen in FIG. 3.

Figure 2:
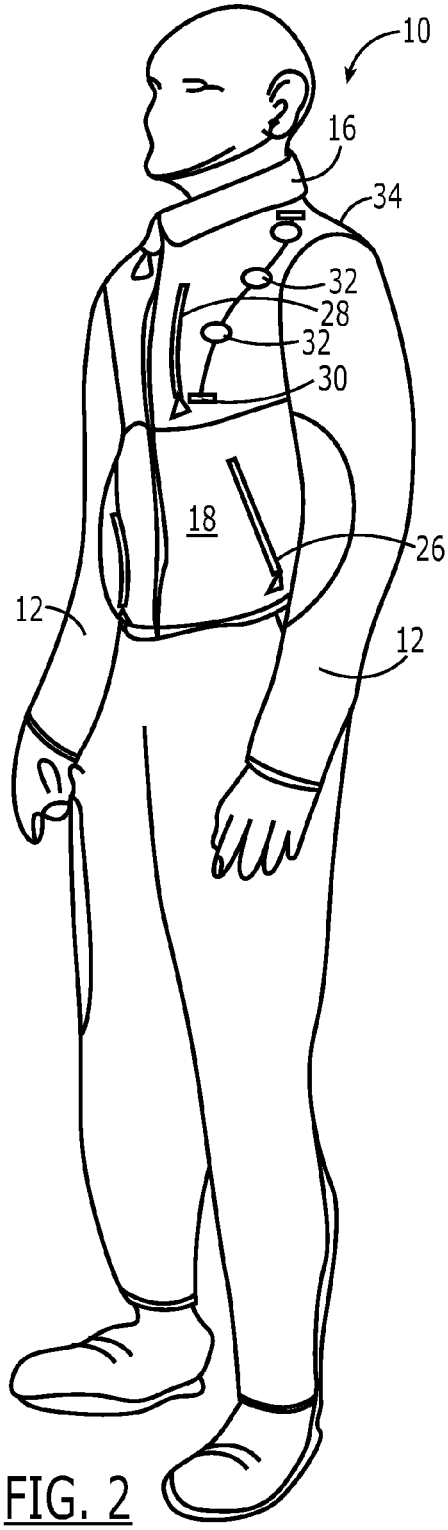
FIG. 2 is a side perspective view of the convertible vest of FIG. 1.

In one embodiment of the invention, the present convertible garment 10 additionally includes multiple pockets 26 along outer surfaces of the vest. At least one of these pockets 28, as shown in FIGS. 1 and 2, preferably includes an opening 20 which communicates from the pocket to the inside surface of the vest. Adjacent this opening and positioned along the inside surface of the vest may be a plurality of loops or adjustable tabs 32 wherein a wire may be secured and led to a second opening 34 communicating from the inside surface of the vest to the outside. This second opening 34 is preferably located along the shoulder of the garment 10 adjacent the collar 16. The user may carry an electronic device such as a cell phone in this pocket 28, pass the wire for an earpiece through the first opening 30, securing the wire along the inside of the vest by means of the loops or tabs 32, so that the wire passes to the outside through the second opening 34. The user may then freely position the earpiece in his/her ear for use of the device. It should be apparent that this arrangement is usable with any type of electronic device which includes a wire and earpiece for private listening.

Figure 3:
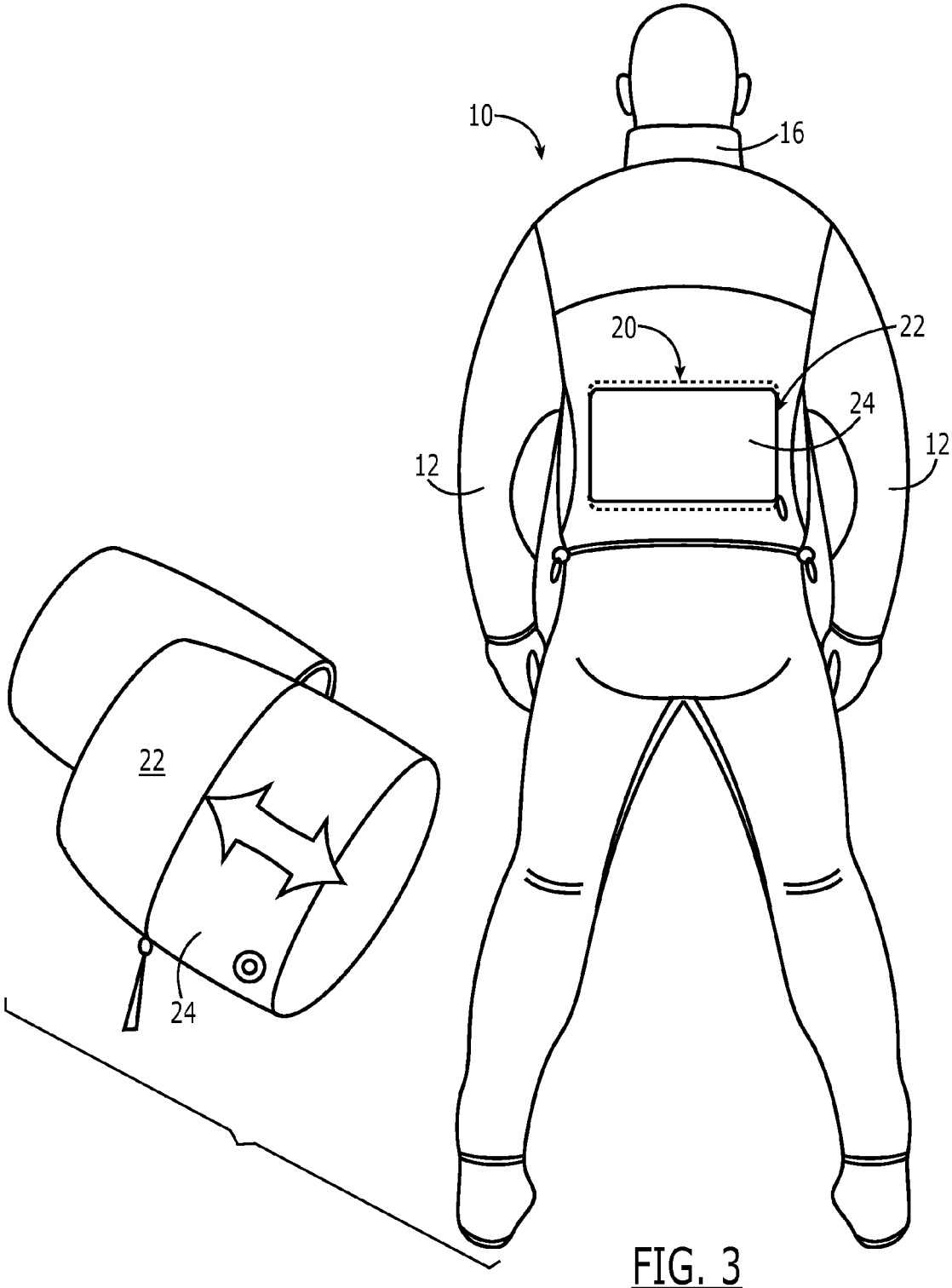

Additional structural features which promote the comfort of the traveler include, as noted above, an inflatable cushion 24 positioned along the back of the convertible vest to provide lumbar support, as shown in FIGS. 3 and 6, and a removable inflatable collar 16, best shown in detail in FIGS. 4A and 4B. As described and seen in FIGS. 3 and 6, the inflatable cushion 24 is housed in a pocket 22 along the back of the vest. This pocket 22 may open either along the outside surface of the vest or along the inside surface, but preferably opens along the back inside surface, as shown in FIG. 6. The cushion 24 may include a blow tube so as to be inflatable by the user, or in one embodiment of the invention, may be self-inflatable by a mechanism as known to the skilled. For example, the cushion 24 may include a small, hand-operable inflating air pump which may be part of the cushion itself or which may be connectable to an air inlet/outlet valve on the cushion. Alternatively, the convertible garment 10 may be disposed with one or more compressed gas cylinders which will provide sufficient pneumatic pressure for inflating the collar 16 cushion, the lumbar cushion 24, or both.

In an embodiment of the present invention the vest's collar 16 is removable by manually actuating a closure, preferably a zipper type of closure, as shown in FIGS. 1 and 4. Similarly to the lumbar cushion 24, the collar 16 may be inflated, as seen in FIG. 4B, to provide neck support for the traveler. The inflatable collar 16, therefore, obviates the need for the traveler to carry a separate neck support pillow when traveling. At the traveler's option, the inflated collar 16 may remain attached to the vest or may be detached for separate use.

Yet a further structural feature of the presently disclosed convertible vest includes the detachable sleeves 12 and a pocket 14 for storing the detached sleeves. The pocket 14 is preferably, but not necessarily, one which is internal in the vest. That is, the sleeve storage pocket 14 is accessible from the inside of the vest 10 and opens along an inside surface thereof. These features are best shown in FIG. 5. Any closure functional for this purpose is intended to be part of the invention, but preferably a zipper closure would be used for attaching and detaching the sleeves 12.

The present vest 10 also includes a drawstring around the waist for adjusting the vest to the wearer. The drawstring could be elastic and preferably includes one or more cylinder clamps, also known as barrel clamps, for securing the drawstring tightened in place. Elastic material may also be employed at the waist of the garment, instead of the drawstring or in addition thereto. Similarly, the sleeve cuffs may include an elastic material, or another type of closure for keeping the cuff secure around the user's wrist, for example, Velcro® tabs. Additionally, reinforcement material may be added, perhaps overlaid onto the sleeves at flexure points such as the elbows, as shown in FIGS. 1-3.

Suitable materials for fabricating the disclosed garment are those known in the art for typical outerwear. For example, it would be preferred if the outer surface of the vest were made of a relatively water and wear resistant material, to provide protection for the wearer from rain and to extend the life of the garment. Further, portions of the garment could be made of fleece or another material which provides a degree of temperature insulation for the wearer. As readily recognized by the skilled, the garment may comprise insulation for protection against the cold, the insulation preferably positioned between the outer and inner surfaces of the garment and/or in the sleeves.

Accordingly, in the drawings and specification there have been disclosed typical preferred embodiments of the invention and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as recited in the appended claims.

The invention claimed is:

1. A garment comprising:

a garment body adapted for covering at least the torso of a person, said garment body having an outer surface and an inner surface;

at least one sleeve detachably connected to said garment body;

at least one sleeve pocket adapted for storing said two sleeves when detached from said garment body, said at least one sleeve pocket having an access opening along said garment's inner surface;

a collar detachably connected along an upper periphery of said garment body, said collar having an associated inflatable cushion;

a lumbar support positioned along a back portion of said garment body, said lumbar support including an inflatable cushion; and a plurality of pockets including at least one pocket having an outlet opening along the inner surface of said garment.

2. The garment of claim 1, further comprising insulation positioned between the outer and inner surfaces.

3. The garment of claim 1, further comprising insulation positioned in said at least one sleeve.

4. The garment of claim 1, wherein said sleeves detachably connect by means of zippers.

5. The garment of claim 1, wherein said collar detachably connects by means of a zipper.

6. A garment comprising:

a garment body adapted for covering at least the torso of a person, said garment body having an outer surface and an inner surface;

at least one sleeve detachably connected to said garment body;

at least one sleeve pocket adapted for storing said two sleeves when detached from said garment body;

a collar detachably connected along an upper periphery of said garment body, said collar having an associated inflatable cushion;

a lumbar support positioned along a back portion of said garment body, said lumbar support comprising a lumbar pocket having an access opening along said garment's inner surface and including an inflatable cushion positioned in the lumbar pocket; and a plurality of pockets including at least one pocket having an outlet opening along the inner surface of said garment.

7. The garment of claim 1, further comprising one or more fasteners along said garment's inner surface adjacent said at least one pocket having an outlet opening thereon.

8. A garment comprising:

a garment body adapted for covering at least the torso of a person and having an outer surface and an inner surface;

two sleeves detachably connected to said garment body;

at least one sleeve pocket adapted for storing said two sleeves when detached from said garment body, said at least one sleeve pocket having an access opening along said garment's inner surface;

a detachable inflatable collar connected along an upper periphery of said garment body;

a lumbar support positioned along a back portion of said garment body, said lumbar support including an inflatable cushion; and a plurality of pockets including at least one pocket having an outlet opening along the inner surface of said garment.

9. The garment of claim 8, further comprising insulation positioned between the outer and inner surfaces.

10. The garment of claim 8, further comprising insulation positioned in said two sleeves.

11. The garment of claim 8, wherein said sleeves detachably connect by means of zippers.

12. The garment of claim 8, wherein said collar detachably connects by means of a zipper.

13. The garment of claim 8, wherein said lumbar support comprises a lumbar pocket having an access opening along said garment's inner surface and having said inflatable cushion positioned therein.

14. The garment of claim 8, further comprising one or more fasteners along said garment's inner surface adjacent said at least one pocket having an outlet opening thereon.

15. A garment comprising:

a garment body adapted for covering at least the torso of a person and having an outer surface and an inner surface;

two sleeves removably connected to said garment body;

at least one sleeve pocket adapted for storing said two sleeves when removed from said garment body, said at least one sleeve pocket having an access opening along said garment's inner surface;

a removable inflatable collar cushion connected along an upper periphery of said garment body;

a lumbar pocket positioned along a back portion of said garment body and having an inflatable cushion positioned therein;

a plurality of pockets including at least one pocket having an outlet opening along the inner surface of said garment; and a source of pneumatic pressure operable for inflating at least one of said collar and said cushion.

16. The garment of claim 15, further comprising insulation positioned between the outer and inner surfaces.

17. The garment of claim 15, further comprising insulation positioned in said two sleeves.

18. The garment of claim 15, wherein said sleeves detachably connect by means of zippers.

19. The garment of claim 15, wherein said collar detachably connects by means of a zipper.

20. The garment of claim 15, wherein said lumbar support comprises a lumbar pocket having an access opening along said garment's inner surface and having said inflatable cushion positioned therein.

21. The garment of claim 15, further comprising one or more fasteners along said garment's inner surface adjacent said at least one pocket having an outlet opening thereon.

22. The garment of claim 15, wherein said source of pneumatic pressure comprises a hand operable air pump.

23. The garment of claim 15, wherein said source of pneumatic pressure comprises a gas cylinder.

* * * * *